US008465603B2

(12) United States Patent
Grobler et al.

(10) Patent No.: US 8,465,603 B2
(45) Date of Patent: Jun. 18, 2013

(54) METHOD AND DEVICE FOR CONTROLLING PROCESS GASES FOR HEAT TREATMENTS OF METALLIC MATERIALS/WORKPIECES IN INDUSTRIAL FURNACES

(75) Inventors: Werner Hendrik Grobler, Bedburg-Hau (DE); Thomas Eversmann, Dorsten (DE); Bernd Edenhofer, Kleve (DE); Jens Bechthold, Hamminkeln (DE); Dirk Joritz, Wesel (DE); Nils Bernhagen, Kleve (DE)

(73) Assignee: IPSEN, Inc., Cherry Valley, IL (US)

( * ) Notice: Subject to any disclaimer, the term of this patent is extended or adjusted under 35 U.S.C. 154(b) by 267 days.

(21) Appl. No.: 12/968,375

(22) Filed: Dec. 15, 2010

(65) Prior Publication Data

US 2011/0139265 A1 Jun. 16, 2011

(30) Foreign Application Priority Data

Dec. 16, 2009 (DE) ..... 10 2009 058 642

(51) Int. Cl.
*F17D 1/16* (2006.01)

(52) U.S. Cl.
USPC ..... 148/508; 148/216; 148/633

(58) Field of Classification Search
USPC ..... 148/508, 216, 206, 633
See application file for complete search history.

(56) References Cited

U.S. PATENT DOCUMENTS 1,961,766 A * 6/1934 Jennings ..... 266/97
8,313,586 B2 * 11/2012 Edenhofer et al. ..... 148/216
8,333,852 B2 * 12/2012 Grobler et al. ..... 148/633

* cited by examiner

*Primary Examiner* — Scott Kastler
(74) *Attorney, Agent, or Firm* — Dann, Dorfman, Herrell and Skillman, P.C.

(57) ABSTRACT

For regulating process gases for heat treatments of metal materials/workpieces in industrial furnaces (1), which have at least one treatment chamber (2), at least one burnoff point (4) having at least one first valve (4.1), and a regulator (5) having pressure meter (5.1), the burnoff point (4) is only to be opened as a function of requirements related to the process gas. For this purpose, in a first step, with open first valve (4.1), a quantity of a flushing gas (6.1) of the gas mixture (6) of the respective process gas is supplied in a controlled manner to the industrial furnace (1) and then burned off, in a second step, the valve (4.1) is closed, the industrial furnace (1) is regulated to a preset furnace pressure and this is permanently detected via the pressure meter (5.1), in a third step, with the target pressure of the industrial furnace achieved, this pressure is detected via the pressure meter (5.1) and maintained, the first valve (4.1) further remaining closed. In a fourth step, the flushing gasification can be activated and adjusted. In the event of large pressure rise, in a fifth step, an overpressure flap (4.3) of the burnoff point (4) can be opened in a controlled manner via a fixed limiting value for pressure dissipation.

12 Claims, 2 Drawing Sheets

METHOD AND DEVICE FOR CONTROLLING PROCESS GASES FOR HEAT TREATMENTS OF METALLIC MATERIALS/WORKPIECES IN INDUSTRIAL FURNACES

BACKGROUND OF THE INVENTION

1. Field of the Invention

The invention relates to a method and a device for regulating process gases for heat treatments of metal materials/workpieces in industrial furnaces, which have at least one treatment chamber, at least one burnoff point having gastight closable valve, and a pressure regulator, at least one component of the respective process gas being prepared in at least one process-relevant range of dimensions.

2. Description of the Related Art

In general, it is known in industrial furnaces that, for example, in the case of typical carburization gassing, the flushing method is applied. I.e., an established quantity of protective gas is permanently supplied to the furnace continuously and is exhausted from the furnace while being burned off (flared off) at a burnoff point. This flushing is necessary in order to achieve a quasi-stationary equilibrium state in the atmosphere through mixing of continuously newly supplied protective gas and/or natural gas-air mixtures and thus be able to regulate the carbon (C) potential.

On the one hand, the thermal loss during flare off of the protective gas at the burnoff and, on the other hand, the actual gas loss, which must be compensated for by new components of the process gas, are disadvantageous in this continuous furnace flushing technique. In addition, the burnoff gas has a C potential previously defined by the regulator, which is also no longer usable and is simply burned off.

According to DE 10 2008 029 001.7 B1, the processing effect of the gas control in industrial furnaces was improved in that, to save protective gas and reduce heating energy losses, a hydrocarbon was supplied on demand for the carburization and the C potential in the protective gas was regulated and reactions which cannot be regulated and/or are undesired were prevented. A novel protective gas recirculation system was thus provided for gas carburization. The components carbon dioxide, oxygen, and water vapor react therein in a preparation chamber of an industrial furnace with a supplied hydrocarbon to in turn form carbon monoxide and hydrogen, in a catalytically supported manner. The regeneration of already "consumed" protective gas, i.e., a protective gas having a low C potential, is advantageously thus achieved. The C potential regulation occurs in the preparation chamber of the treatment chamber. The "prepared" protective gas can then be fed back into the treatment chamber at one or more points, so that a real cycle results for the gas carburization.

The protective gas is regularly no longer burned off, but rather supplied by recirculation back to the heating chamber, after it has passed through an intermediate step, the preparation, in an internal or external preparation chamber. It is thus no longer flushed as previously, but rather reused.

Through the carburization inside the heating chamber, the concentrations of $CO_2$, $H_2O$, and $O_2$ rise and the C level drops. This depleted gas is not combusted, but rather conducted using a circulator into the mentioned preparation chamber, which is locally separated from the heating chamber. A C level enrichment occurs here through the finely-dosed addition of natural gas, the following reactions occurring and the concentrations dropping again.

The gasification method cited according to DE 10 2008 029 001.7 B1 was refined according to DE 10 2009 038 598.3 in that the generation and enrichment of the protective gas can be performed in this case as a separate preparation and separated from the batch. The batch can thus always have a homogeneous gas atmosphere applied thereto.

However, for process-related and also safety-technical reasons, industrial furnaces still require a burnoff point having gastight closable valve and a pressure regulator, which is not predominantly used for permanent flare-off, but must also include the function of explosion safety, during the performance of heat treatments using the process gases described, for example. Known burnoff points in this context are functionally characterized by a permanent gas flow and thus by disadvantageously high gas losses according to internally known prior art. This is mechanically solely solved in that an overpressure flap, which is not terminated completely gastight, is provided for dissipating overpressure occurring in the furnace chamber, this flap not being regulated in the normal case, but rather at best being opened according to rigidly set experiential values.

SUMMARY OF THE INVENTION

The invention is based on the object of providing a method and a device for regulating process gases for heat treatments of metal materials/workpieces in industrial furnaces of the type mentioned at the beginning, in which the burnoff point is also only opened as a function of requirements related to process gases, while maintaining both the safety-technical conditions and also conditions which save process gas, this being achieved by a configuration made of valves and slides, which release different process-related burnoff quantities.

This object is achieved in a method for regulating process gases for heat treatments of metal materials/workpieces in industrial furnaces, which has at least one treatment chamber, at least one burnoff point having at least one first valve, and a pressure regulator having pressure meter, the process gas being prepared in at least one component of a respective gas mixture in a range which can be limited and/or being used as a flushing gas in a step of a flushing gasification, in that a) in a first step, with open burnoff valve, a quantity of a flushing gas of the gas mixture of the respective process gas is supplied to the industrial furnace—preferably also in a controlled manner—and then burned off,
b) in a second step, after the above-mentioned step of the flushing gasification, the burnoff valve is closed and optionally the industrial furnace is regulated to a preset furnace pressure and permanently detected via the pressure meter, for which at least one fresh gas valve is regulated so that it only provides a quantity of a fresh gas of the respective gas mixture of the process gas which is sufficient to maintain the pressure of the furnace, and
c) in a third step, when the target pressure of the industrial furnace is achieved, the fresh gas valve is regulated in such a manner that this pressure is further detected via the pressure meter and maintained, in this phase, the burnoff valve further remaining closed, in order to only replace a possibly occurring leakage gas quantity.

In a fourth step, the flushing gasification (cf. step one) can advantageously be activated and adjusted.

The method is further implemented in that in the event of a large pressure rise, in a fifth step, an overpressure flap of the burnoff point for pressure dissipation is opened in a controlled manner via a fixed limiting value.

If the setting of a C level is required for the process, it can be regulated independently of the pressure regulation of the furnace controller by at least one C potential regulator and set via a gas and air supply.

The method can be applied for batch-by-batch heat treatments or in the case of heat treatments of metal materials/workpieces in a pusher furnace.

The flushing gasification which is activated in the fourth step can be adjusted before a batch movement, a batch change, or the charging of a batch.

The controlled flushing gasification can be activated until a flushing time has passed or a selected carbon monoxide content is reached.

The request for the flushing gasification can be initiated from the furnace controller, in order to free the furnace chamber from residues of foreign gases.

The method is particularly suitable for application in protective gas recirculation systems, in which the components carbon dioxide, oxygen, and water vapor are reacted with a supplied hydrocarbon to form carbon monoxide and hydrogen again in a recirculating manner for a gas carburization in an internal or external preparation chamber of the industrial furnace.

In the event of a large pressure rise, in the fifth step, an overpressure flap of the burnoff point is opened, which is ideally closed gastight per se during steps 1 to 4.

The use of a hand slide in the burnoff also makes the method applicable in the special case in which depletion of the furnace atmosphere occurs because of very small leakage gas quantities and thus a defined small quantity of gas must be permanently burned off, which is normally less than the typical burnoff quantities.

The method can particularly unfold its advantages through the combination of a sequence of the method steps one to five if

- in the first step, in terms of a controller after batch change with open burnoff valve, the flushing gas quantity of the gas mixture is supplied to the industrial furnace and burned off, in order to free the furnace chamber from residues of foreign gases, this controlled flushing gasification remaining active until a flushing time has passed or the selected carbon monoxide content is reached in a heating chamber of the industrial furnace, for example, and the request for the flushing gasification is initiated from the furnace controller,
- in the second step, after the above-mentioned flushing phase, in terms of a regulation, the mentioned burnoff valve is closed, the regulator brings the industrial furnace to a preset furnace pressure, which is permanently detected via a pressure meter, for which purpose a fresh gas valve is controlled so that it provides the fresh gas quantity required for the pressure buildup
- in the third step, in terms of a regulation upon achieved target furnace pressure, the mentioned fresh gas valve is controlled so that this pressure, which is further detected via the furnace pressure meter, is maintained, in this phase, the burnoff valve further being closed, in order to only replace the leakage gas quantity required due to leaks, for example, the C level required for the process being regulated independently of the pressure regulation by the furnace controller and being set via gas and air supply and in this phase the burnoff valve being closed in the normal case,
- in the fourth step, the flushing gasification (cf. step 1) is activated and is adjusted before a door and batch movement, for example, and finally
- in the fifth step, in the event of large pressure rise, the overpressure flap for pressure dissipation is opened in a controlled manner via a fixed limiting value.

In terms of the invention, the above-mentioned range, which can be limited, for the preparation of the process gas can have the following dimensions a pressure, a temperature, and/or compositions of the components of the process gas in at least one component of a respective gas mixture.

Furthermore, the mentioned preparation chamber of the industrial furnace can be implemented both internally according to DE 10 2008 029 001.7 B1 or also externally according to DE 10 2009 038 598.3, in the last mentioned case, generation and enrichment of a protective gas being performed as a separate preparation and separately from the batch.

The device for performing the method comprises a) the preparation chamber for the preparation of the process gas, b) at least one burnoff point for the burnoff of the flushing gas having at least one burnoff valve for a controlled dissipation of a quantity of the flushing gas of the gas mixture, c) the pressure regulator having pressure meter for the pre-settable and permanently detectable furnace pressure, and d) a fresh gas valve for the provision of the quantity of the fresh gas of the respective gas mixture of the process gas which is required for the pressure buildup.

The gastight closable overpressure flap of the burnoff point for the controlled pressure dissipation completes the device.

The regulated setting of the gas and air supply is performed by the C potential regulator, which acts independently of the pressure regulation of the furnace controller.

For the special cases, such as small leakage gas quantities of the furnace, a hand slide is provided, in order to generate a leakage gas quantity, which is at least required for maintaining the atmospheric composition, by gas burnoff.

The device comprises solenoid valves or adjustable valves as valves, which are activated depending on the processing state in the furnace and release the flow through the burnoff point. Various gas quantities may thus be burned off in various burnoff trains. As a function of the program step, furnace pressure, and the atmospheric composition, different valves are activated and only the minimal required quantity of gas is thus burned off. In the case of a disturbance, all valves release the passage and thus allow a rapid flushing out procedure of the furnace chamber. An overpressure flap, which was also typical up to this point, is now implemented according to the invention, however, so that it is regulated closed tight up to an established furnace pressure and is regulated to open upon exceeding this pressure and thus—also essentially regulated—ensures a rapid pressure dissipation.

The furnace pressure regulation is performed via the controlled feed of a gas mixture. In the normal case, the burnoff point is closed using the overpressure flap. For the pressure regulation, the furnace pressure is permanently detected and the mixture quantity required for maintaining the pressure is supplied.

During the pressure rise gasification, if the pressure falls below a minimum furnace pressure, the maximum possible gas mixture quantity is supplied until a set opening time of the valves has passed or a preset furnace pressure is reached. The control of the burnoff valves is performed similarly to the furnace pressure regulation in this case.

DETAILED DESCRIPTION OF A PREFERRED EMBODIMENT

Figure 1:
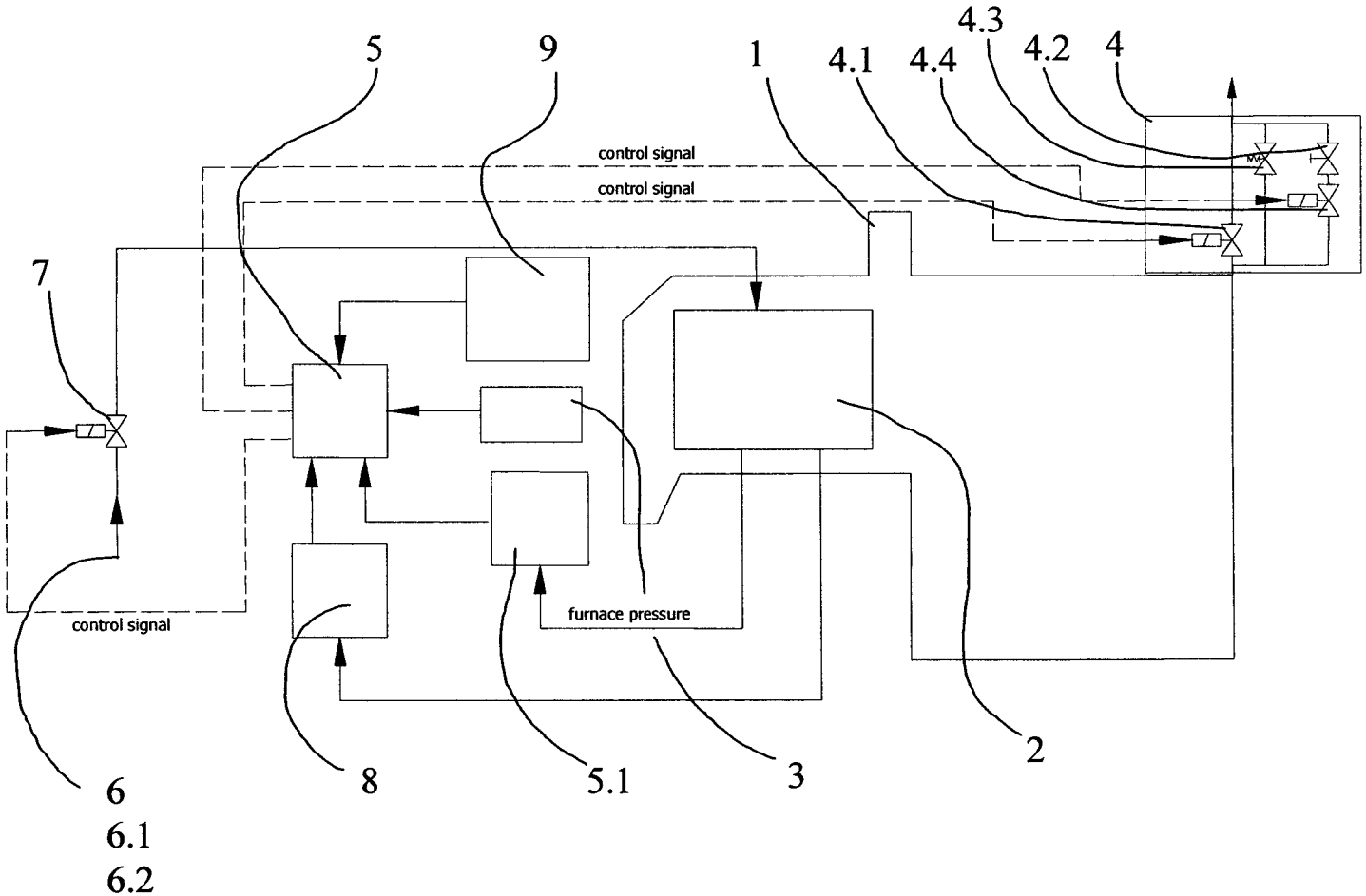
FIG. 1 shows the method sequence of a regulation according to the invention as a schematic block diagram in a selected example.
Figure 2:
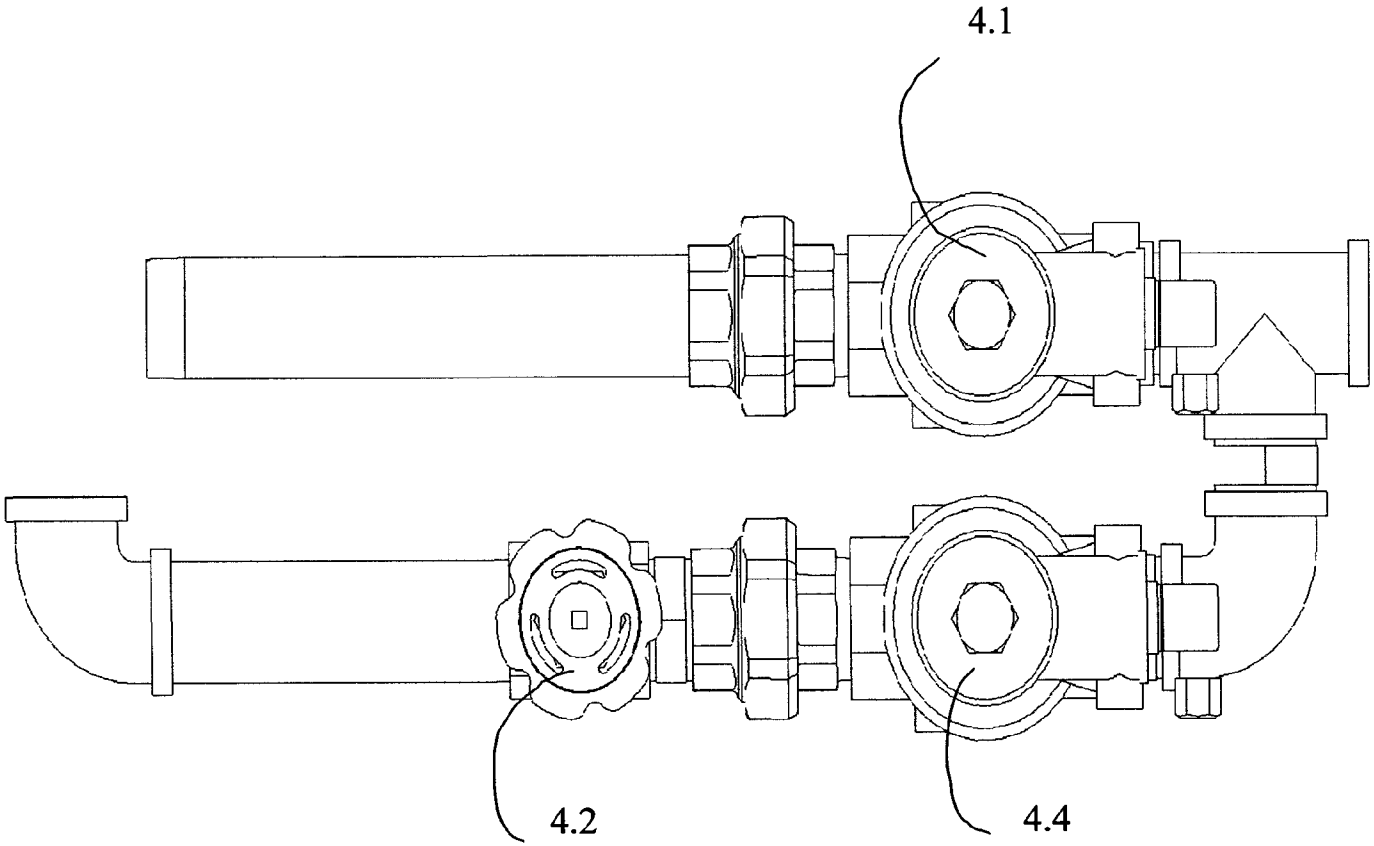
FIG. 2 shows an exemplary embodiment relating to a configuration of a burnoff valve and a second burnoff line, which is equipped with hand slide and solenoid valve

An industrial furnace 1 having a treatment chamber 2 is schematically shown in an exemplary embodiment in FIG. 1. The treatment chamber 2 is connected to a regulator 5 via a pressure meter 5.1, the regulator 5 receiving both request signals for a flushing gasification from a typical furnace controller 9 and also signals from a C potential regulator 3 and the pressure meter 5.1 about the furnace pressure. Furthermore, the regulator 5 receives values from a carbon monoxide analyzer 8.

The regulator outputs signals for the opening or closing of a burnoff valve 4.1, implemented as a solenoid valve, for example, a burnoff point 4, and signals of a fresh gas valve 7, implemented as a solenoid valve, for example.

According to the method in a first step, in terms of a control after a batch change, for example, with open burnoff valve 4.1, a flushing gas quantity 6.1 of a gas mixture is supplied to the industrial furnace 1 and burned off, in order to free the furnace chamber from residues of foreign gases, this controlled flushing gasification remaining active until a flushing time has passed or the selected carbon monoxide content is reached in a heating chamber (not shown in greater detail), for example, measured via the carbon monoxide analyzer 8, and the request for the flushing gasification is initiated from the typical furnace controller 9, in the second step, after the above-mentioned flushing phase, the mentioned burnoff valve 4.1 is closed in terms of a regulation, the regulator 5 brings the industrial furnace to a preset furnace pressure, which is permanently detected via the pressure meter 5.1, for which purpose the setting of the fresh gas valve 7 is controlled so that it provides a fresh gas quantity 6.2 required for the pressure buildup, in the third step, in terms of a regulation upon achieved target furnace pressure, the mentioned fresh gas valve 7 is controlled so that this pressure, further detected via the pressure meter 5.1, is maintained, in this phase, the burnoff valve 4.1 further being closed, in order to only replace the leakage gas quantity required due to leaks, for example, the C level required for the process being regulated independently of the pressure regulation by the furnace controller via the C potential regulator 3 and being set via gas and air supply.

The fundamental principle of the method is thus established.

In this example, in a fourth step the flushing gasification (cf. step 1) is activated and adjusted before a door and batch movement, for example.

Finally, in a fifth step, in the event of large pressure rise, an overpressure flap 4.3 can also be opened for pressure dissipation in a controlled manner via a fixed limiting value.

For this purpose, the device for performing the method essentially comprises a) the preparation chamber 2 for the preparation of the process gas, b) at least the one burnoff point 4 for the burnoff of the flushing gas 6.1 having at least one burnoff valve 4.1, e) the regulator 5 having pressure meter 5.1 for the presettable and permanently detectable furnace pressure, and f) at least one fresh gas valve 7 for the provision of the required flushing gas quantity 6.1 and the quantity of the fresh gas 6.2 of the respective gas mixture of the process gas which is required for the pressure buildup, and g) the gastight closable overpressure flap 4.3 of the burnoff point 4 for the controlled pressure dissipation.

An assigned hand slide 4.2 having shutoff valve 4.4 allows the continuous burnoff of a small exhaust gas quantity through corresponding slide settings.

INDUSTRIAL APPLICABILITY

The invention allows the burnoff point 4 to only be opened as a function of requirements related to the process gas, and while maintaining both the safety-technical conditions and also the environmentally-protective saving of process gases.

LIST OF REFERENCE NUMERALS

1=industrial furnace
2=treatment chamber
3=C potential regulator
4=burnoff point
4.1=burnoff valve
4.2=hand slide
4.3=overpressure flap
4.4=shutoff valve
5=regulation
5.1=pressure meter
6=gas mixture
6.1=flushing gas quantity
6.2=fresh gas quantity
7=fresh gas valve
8=carbon monoxide analyzer
9=furnace controller

The invention claimed is:

1. A method for controlling the flow of a process gas for the heat treatment of metal materials/workpieces in an industrial furnace (1), which has at least one treatment chamber (2), at least one burnoff point (4) having a first valve (4.1), and a regulator (5) having a pressure meter (5.1), wherein the process gas comprises a gas mixture (6) and is used as a flushing gas (6.1) and as a fresh gas (6.2), the method comprising the following steps:

a) in a first step, with first valve (4.1) open, i) supplying a flow of the flushing gas (6.1) through a valve (7) to the industrial furnace (1), such that at least a portion of the flushing gas exits the industrial furnace through the first valve (4.1), and then ii) burning off the portion of the flushing gas that exits the industrial furnace through the first valve (4.1);

b) in a second step, performed after said first step, closing the first valve (4.1) when a preset flushing time has elapsed or when a preselected carbon monoxide content is detected in the treatment chamber; and then c) in a third step, detecting a gas pressure in the industrial furnace and when a target gas pressure is detected, adjusting the valve (7) in such a way that a regulated flow of the process gas is provided as the fresh gas in a quantity sufficient to maintain the gas pressure in the furnace at or above the target gas pressure.

2. The method according to claim 1, wherein in the third step the gas pressure in the furnace is detected by the pressure meter (5.1) and the valve (7) is adjusted so that it provides a quantity of the fresh gas (6.2) which is sufficient for replacing a quantity of gas that has leaked from the furnace.

3. The method according to claim 1 wherein the first step is initiated before movement of a batch of the metal materials/workpieces into or from the treatment chamber (2).

4. The method according to claim 1, wherein an overpressure flap valve (4.3) of the burnoff point (4) is opened for pressure dissipation when the gas pressure in the furnace rises above a fixed limiting value.

5. The method according to claim 1 wherein when a carbon level is required for a heat treatment process, the carbon level in the treatment chamber is controlled using at least one carbon potential regulator (3) which operates to modify the gas mixture via a gas and air supply so that the required carbon level is achieved.

6. The method according to claim 1 wherein the heat treatment comprises batch-by-batch heat treatments of the metal materials/workpieces.

7. The method according to claim 1 wherein the method is carried out in a pusher furnace.

8. The method according to claim 3, wherein the first step is initiated before a batch change in the treatment chamber or before charging of a batch into the treatment chamber.

9. The method according to claim 1 wherein the first step is initiated by a furnace controller (9), in order to free the treatment chamber (2) from residues of foreign gases.

10. The method according to claim 1 which is applied in a protective gas recirculation system for a gas carburization process, and wherein components of the gas mixture comprise carbon dioxide, oxygen, and water vapor react with a supplied hydrocarbon to form carbon monoxide and hydrogen again in a recirculating manner.

11. The method according to claim 4 wherein the overpressure flap (4.3) is closed in a gastight manner as long as the gas pressure in the furnace is at or below the fixed limiting value.

12. The method according to claim 1 comprising the step of operating a hand slide (4.2) associated with a shutoff valve (4.4) to adjust the flushing gas flow, whereby the quantity of the flushing gas burned off is limited.

* * * * *